US006279400B1

(12) United States Patent
Johnson et al.

(10) Patent No.: US 6,279,400 B1
(45) Date of Patent: Aug. 28, 2001

(54) APPARATUS AND METHOD FOR MEASURING AND SELECTIVELY ADJUSTING A CLEARANCE

(75) Inventors: Christopher Donald Johnson, Clifton Park; Weiping Wang; Thomas Huei Hwang, both of Schenectady, all of NY (US); Emily Yixie Shu, San Jose, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/268,305

(22) Filed: Mar. 16, 1999

(51) Int. Cl.[7] ..... G01C 3/06
(52) U.S. Cl. ..... 73/655; 356/4.03
(58) Field of Search ..... 73/865.8, 116, 73/655, 656; 356/4.01, 4.03, 4.07; 250/559.19, 559.38; 348/140; 227/321, 358, 359, 413, 416

(56) References Cited

U.S. PATENT DOCUMENTS 4,357,104 * 11/1982 Davinson .
4,447,063 * 5/1984 Kotzur et al. .
4,497,493 * 2/1985 Sall et al. .
5,403,019 * 4/1995 Marshall .
5,448,924 * 9/1995 Nagal et al. .
5,545,007 * 8/1996 Martin .

FOREIGN PATENT DOCUMENTS

354058047 * 5/1979 (JP) ..... 356/4.03
3 632 22213 * 9/1988 (JP) ..... 356/4.03

* cited by examiner

*Primary Examiner*—Robert Raevis
(74) *Attorney, Agent, or Firm*—Patrick K. Patnode; Douglas E. Stoner

(57) ABSTRACT

A technique for measuring and selectively adjusting a clearance between a stationary object and desirably a rotating object includes a non-contact, sensing system having a sensor attachable to the stationary object, a mask having a predetermined sized viewport or aperture that sets or limits the sensing or operation of the sensor, and a controller. The sensor is operable for sensing within a field of view a portion of the rotating object and generating a signal in response thereto. The field of view varies in response to varying the clearance between the sensor and the second object. Desirably, the portion of the second object includes a varying pattern. The controller is operable to determine the clearance between the first object and the second object in response to the signal. In another embodiment, sensing system is operable to adjust the clearance by controller providing an electrical current to a resistive heating element in the thermally expandable portion of a plurality of segmented labyrinth seals. The sensing system is also operable to measure vibration of the rotating object.

19 Claims, 6 Drawing Sheets

APPARATUS AND METHOD FOR MEASURING AND SELECTIVELY ADJUSTING A CLEARANCE

BACKGROUND INFORMATION

This invention relates to measurements of clearances, and more specifically, to an apparatus and method for measuring or selectively adjusting a clearance between two objects such as a stationary object and a rotating object.

Rotating systems typically have clearances or gaps to avoid contact or rubs during operation due to manufacturing tolerances and thermal expansion or mechanical strain effects. Undesirably, clearances generally result in loss of efficiency of the system. For example, in a pressurized system, clearances cause loss in efficiency due to blowby or degradation of pressure ratios. Typically, manufacturing and design costs increase as attempts are made to reduce the size of clearances in a system.

In a jet turbine engine, for example, a clearance exists between the thin-walled casing and the tips of the rotor blades. The thin walled casing is designed so that during operation it can be heated or cooled to vary the size of the clearance between the casing and the tip of the blade particularly during start-up and shutdown. Rotating systems having a thick casing, however, can not be readily resized by heating or cooling the thick casing to adjust the clearance between the casing and a rotor blade tip.

Therefore, there is a need for a low cost, on-line apparatus and method for measuring a clearance between objects and selectively adjusting and optimizing the clearance during operation.

SUMMARY OF THE INVENTION

The above-mentioned need is met by the present invention which in one aspect relates to a technique for measuring a clearance between a surface of a first object and a surface of a second object. The system includes a sensor for sensing within a field of view a portion of the second object and generating a signal in response thereto. The field of view varies in response to varying the clearance between the sensor and the second object. A controller determines a clearance between the surface of the first object and the surface of the second object in response to the signal.

The controller is operable to determine the clearance in response to a magnitude of the signal or in response to the signal comprising a plurality of signals. Advantageously, the second object is a rotating object and the portion of the second object has a varying pattern.

In another aspect of the present invention, a system for adjusting the clearance between a first object and a second object includes a movable seal disposed between the first object and the second object. A sensor is attachable to at least one of the first object and the seal for sensing within a field of view a portion of the second object and generating a signal in response thereto. A controller is operable to adjust a position of the seal relative to the second object to selectively adjust the clearance therebetween in response to the signal. Desirably, the seal is a segmented labyrinth seal having a thermally expandable portion. Advantageously, the second object is a rotating object and the portion of the second object has a varying pattern.

In another aspect of the present invention, a system is provided for measuring vibrations of an object. Desirably, a portion of the object includes a two-dimensional pattern of spaced-apart reflective elements.

In still another aspect of the present invention, a method for measuring a clearance between a surface of a first object and a surface of second object comprises the steps of sensing within a field of view a portion of the second object and generating a signal in response thereto, the field of view varying in response to varying the clearance between the first object and the second object, and determining the clearance between the first object and the second object in response to the signal.

DETAILED DESCRIPTION OF THE INVENTION

Figure 1:
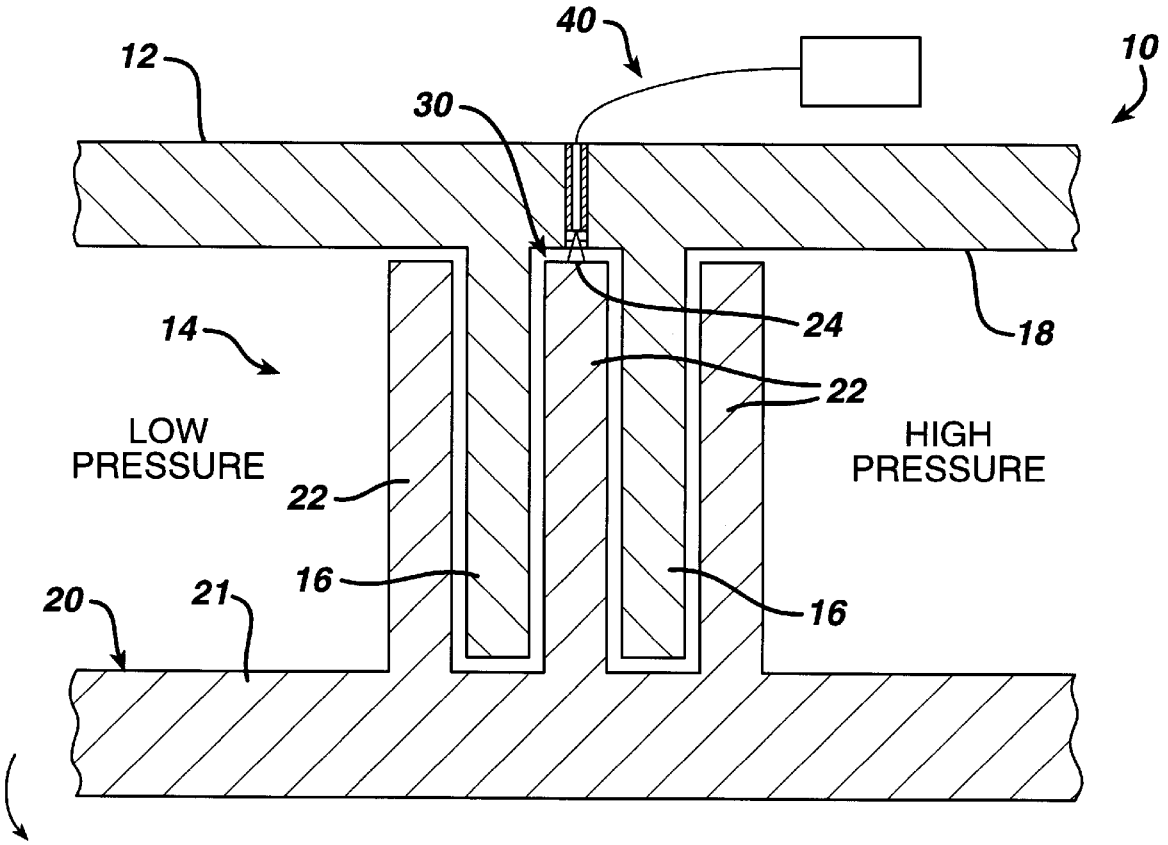
FIG. 1 is a cross-sectional view of a compressor, which is symmetric about a center line, and to which is attached a non-contact, clearance measurement system according to the present invention.

FIG. 1 illustrates a cross-sectional view of a compressor 10 such as in a gas turbine. Compressor 10 includes a shroud or casing 12 defining therein a chamber 14 and having a plurality of inwardly extending stationary blades 16. Compressor 10 also includes a rotor 20 having a plurality of outwardly extending rotating blades 22.

A rotor blade tip surface or portion 24 of blades 22 and an inner surface 18 of casing 12 define a gap or tip clearance 30 to avoid rubs during operation. In this exemplary compressor, air leakage or blowby through clearance 30 from a high pressure side of compressor 10 to a low pressure side of compressor 10 reduces the efficiency of compressor 10.

Figure 2:
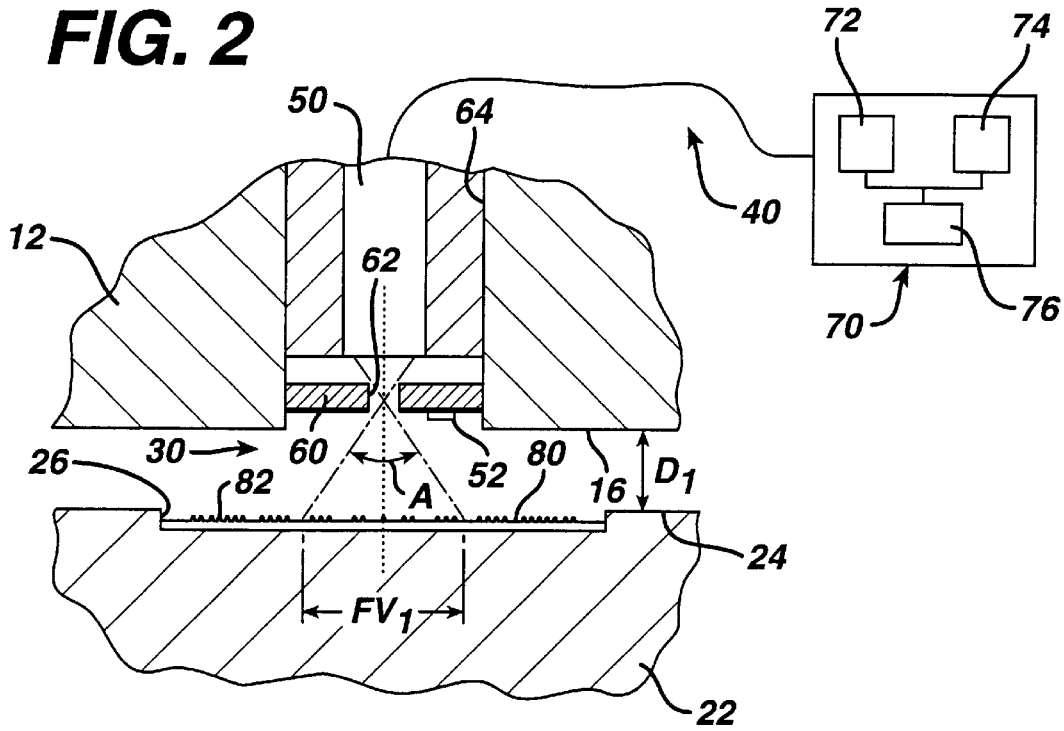
FIGS. 2 and 3 are enlarged views of the non-contact, clearance measurement system shown in FIG. 1.
Figure 3:
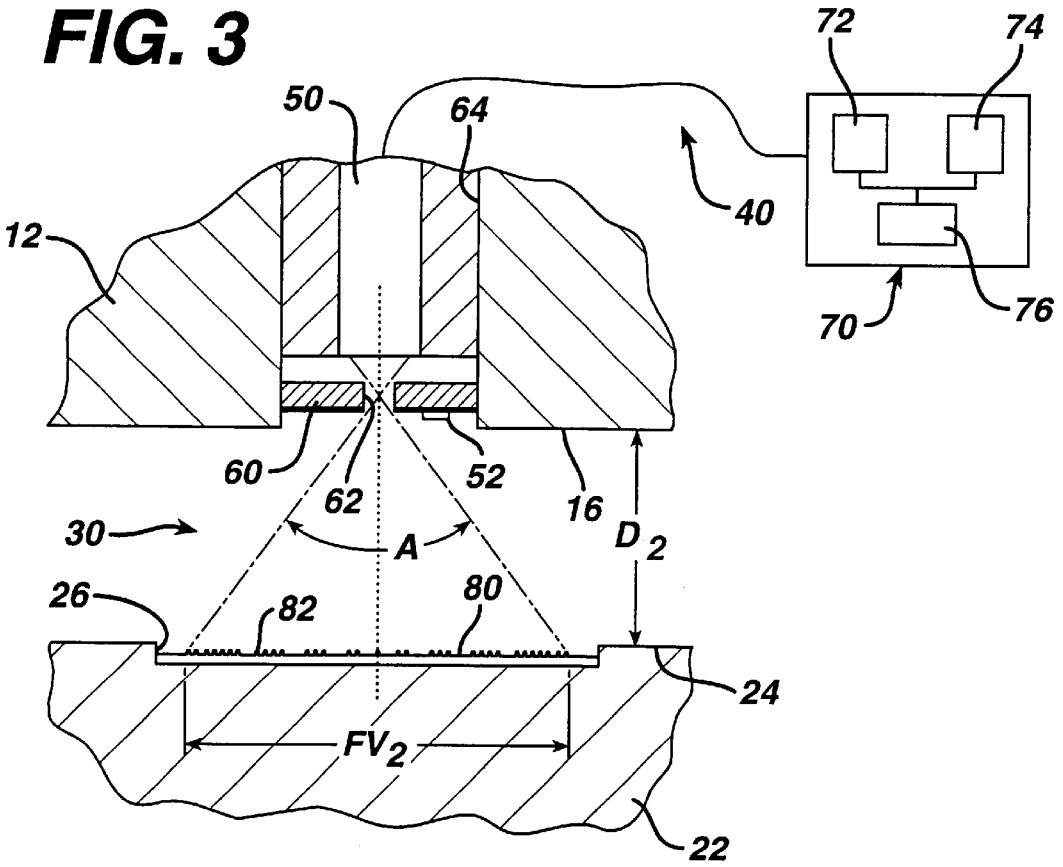

With reference to FIGS. 1–3, a non-contact, clearance measuring system 40 is operable to determine a magnitude of clearance 30, i.e., the size, width, or distance between rotor blade tip surface 24 and inner surface 18 of casing 12. In this exemplary embodiment, as best shown in FIGS. 2 and 3, system 40 includes a sensor 50, a mask 60 having a predetermined sized viewport or aperture 62 that sets or limits the sensing or operation of sensor 50, and a computing environment of controller 70 connected to sensor 50. Sensor 50 is desirably attachable to stationary casing 12 by being inserted through a bore 64 extending through casing 12.

Depending on the distance between inner surface 16 of casing 12 and rotor blade tip surface 24, the magnitude of clearance and the area of the field of view observable by sensor 50 varies. For example, FIG. 2 illustrates clearance 30 having a magnitude D1 and a field of view FV1, i.e., the portion or area of rotor blade tip surface 24 sensed by sensor 50. As the magnitude of clearance 30 increases the area of the field of view increases. FIG. 3 illustrates a clearance 30 having a magnitude D2 and a field of view FV2. The relationship of the magnitude of the signal generated by sensor 50 is generally fixed (e.g., generally linearly or proportionally related) via angle A being fixed. Such an arrangement readily allows precalculation of clearances to field of views or determination of a clearance based on the field of view observed.

From the present description, it will be appreciated by those skilled in the art that for a circularly-shaped viewport, the field of view will be circularly-shaped. It is also appreciated that the viewpoint may have other configurations, e.g., square, rectangular, or other configurations depending upon the shape of the field of view desired.

Desirably, sensor 50 is a light sensor, for example, a photodiode, for observing and sensing reflected light from rotor blade tip surface 24, and generating a signal in response thereto to controller 70. Controller 70 includes, for instance, at least one central processing unit 72, a memory or main storage 74, and one or more input/output devices 76. Memory or main storage 74 of controller 70 is operable to store a predetermined database of signal measurements to clearance measurements. Controller 70 includes suitable computer programming for comparing the signal generated by sensor 50 to the predetermined database to determine a magnitude of clearance 30. Alternatively, memory or main storage 74 may include programming code for computing the clearance directly from the magnitude of the signal.

Figure 4A:
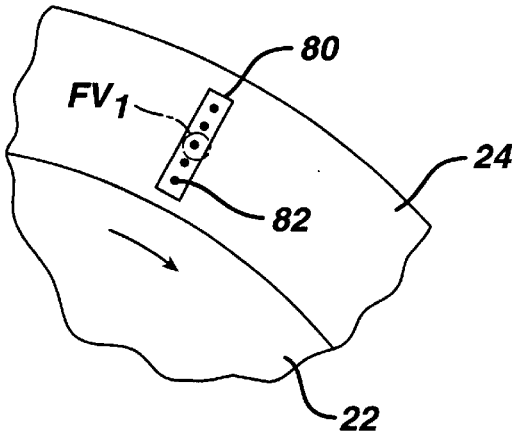
FIGS. 4A and 4B are partial, perspective views of the central rotor blade shown in FIG. 1.
Figure 4B:
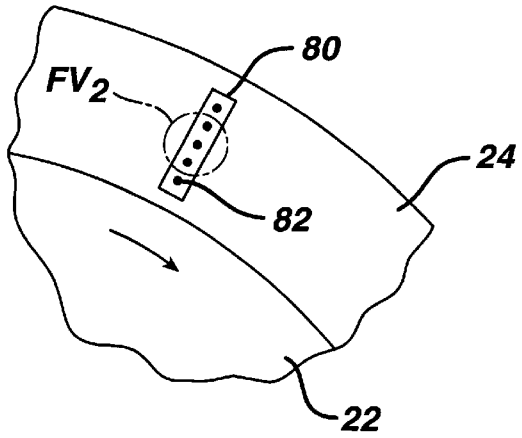

Desirably, rotor blade tip surface 24 includes a reflective pattern or target 80 having a varying pattern. As best shown in FIGS. 4A and 4B, in one embodiment, target 80 comprises a liner pattern of reflective elements 82 which are mounted on rotor blade tip surface 24 and aligned with an axis of rotor shaft 21 (FIG. 1) of rotor 20 (FIG. 1). In this exemplary embodiment, target 80 includes five micron sized glass reflecting beads on a bed of 400C Polyamide which is then attached to rotor blade tip surface 24. The Polyamide both absorbs light and holds the beads in correct orientation during a vacuum sealing process. The target may alternatively include chemical, mechanical, or laser etching, adding or removing of material to the rotor blade tip surface (e.g., by photolithography) to provide an optical pattern of varying density. In addition, the target may be a sealed high temperature glass vacuum impregnated optical disc. Desirably, target 80 is affixed to the rotor blade tip 24 by being mounted into a recess 26 (FIGS. 2 and 3) so that the target is shielded from the flow of blowby gas and protected should a contact or a rub occur between rotor blade tip surface 24 and inner surface 16 (FIGS. 2 and 3).

Figure 5A:
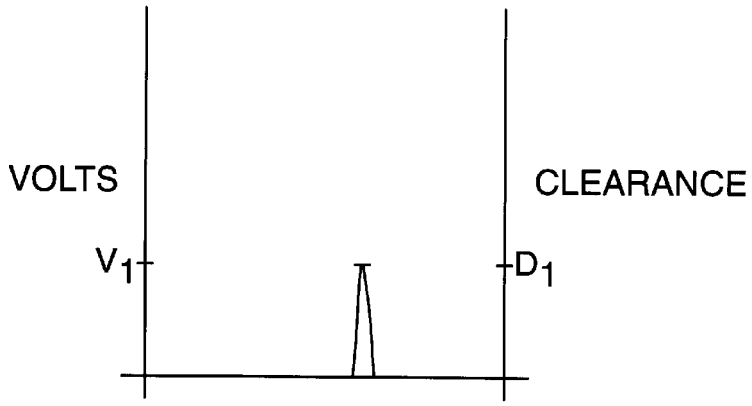
FIGS. 5A and 5B are graphs of the signals generated by the clearance measurement sensor shown in FIG. 1 corresponding to the field of views illustrated in FIGS. 2 and 4A, and FIGS. 3 and 4B, respectively.
Figure 5B:
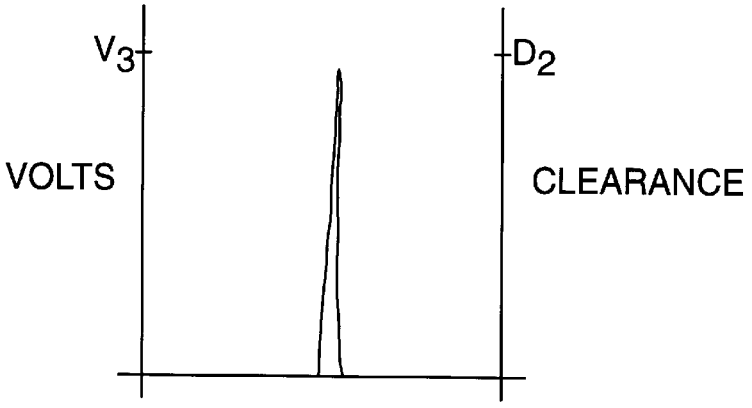

With reference to FIGS. 4A and 5A, as target 80 passes through field of view FV1, one of reflective elements 82 is observed or detected so that sensor 50 (FIG. 2) generates a signal having a magnitude of V1 which corresponds to clearance D1 (see also FIG. 2). With reference to FIGS. 4B and 5B, as target 80 passes through field of view FV2, three of reflective elements 82 are observed or detected so that sensor 50 (FIG. 3) generates a signal having a magnitude of V2 which corresponds to clearance D2 (see also FIG. 3).

From the present description, it will be appreciated by those skilled in the art that target 80 may comprise a single elongated strip wherein the magnitude of the signal varies in response to the size of the field of view. Desirably, the use of reflective elements 82 allows a signal to have a discrete level or magnitude which can be readily and accurately correlated to a clearance measurement by controller 70. While the exemplary target includes five reflective elements, it will be appreciated that the target may have more or less that five reflective elements.

In another aspect of the present invention, clearance measuring system 40 may further comprise a light emitter 52, as shown in FIGS. 2 and 3, connected to controller 70 for selectively emitting light as target 80 passes through a field of view. For example, in a gas turbine electrical generating plant connected to a 60 $H_z$ grid the speed will be maintained at a generally constant 3,600 rpms so that the rotation of the shaft of the compressor can be synchronized to the passing of target 80 through a field of view. Desirably, an encoder (not shown) on the rotor shaft is operable to determine the position of the rotor shaft, and a synchronizer or a phase-locked loop circuit operably incorporated into controller 70 allows light to be pulsed or strobed as target 80 passes through the field of view. From the present description, it will be appreciated by those skilled in the art that the clearance measuring system may include a bifurcated fiber optic assembly for emitting radiation and receiving the reflection thereof. It will also be appreciated that the emitter and sensor may be operable to emit and detect visible light or nonvisible radiation including coherent electromagnetic radiation from a laser.

Figure 6A:
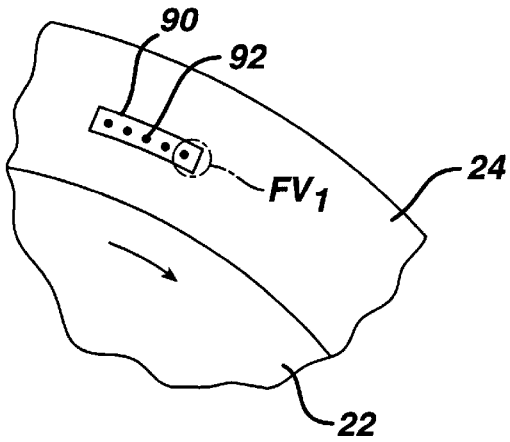
FIGS. 6A and 6B are partial, perspective views of the central rotor blade shown in FIG. 1.
Figure 6B:
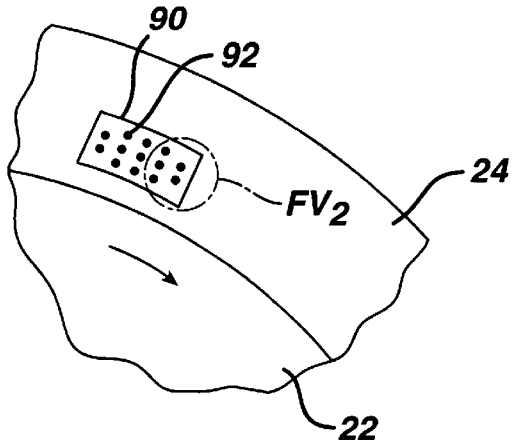
Figure 7A:
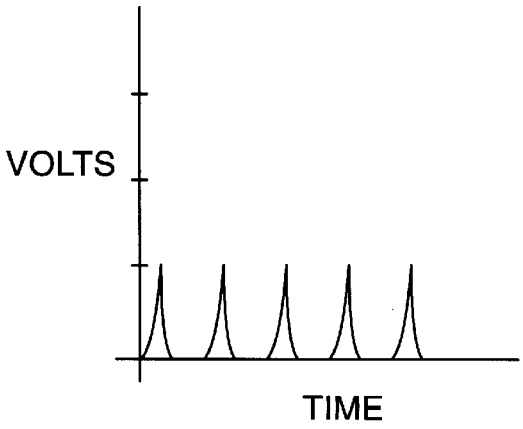
FIGS. 7A and 7B are graphs of the signals generated by the sensor shown in FIG. 1 corresponding to the field of views illustrated in FIGS. 2 and 6A, and FIGS. 3 and 7B, respectively.
Figure 7B:
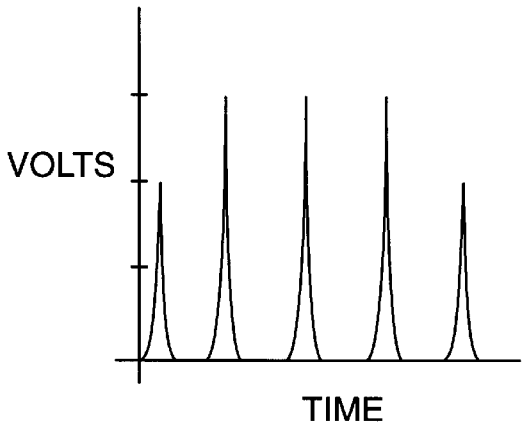

FIGS. 6A and 6B illustrate a target 90 which is mounted on rotor blade tip surface 24 and aligned parallel to a circumference of the shaft. Emitter 52 (FIGS. 2 and 3) may be strobed five times with each time corresponding to one of the five reflective elements 92 being aligned under sensor 50 (FIGS. 1–3) so that a varying signal can be generated by sensor 50 in response to the reflected light from target 90. For example, with a field of view FV1 (FIG. 6A), sensor 50 generates a varying signal having five equal spikes, as shown in FIG. 7A, with each spike having a magnitude corresponding to the reflection from one of reflective elements 92. With a field of FV2 (FIG. 6B), sensor 50 generates a varying signal having five spikes with the first and last having a magnitude corresponding to two of reflective elements 92 and the middle three spikes having a magnitude corresponding to three of reflective elements 92. In this aspect of the invention, memory or main storage 74 of controller 70 is operable to store a predetermined database of varying signal measurements Or patterns to clearance measurements and controller 70 includes suitable computer programming for comparing the signal generated by sensor 50 to the predetermined database to determine a magnitude of clearance 30. Alternatively, the various spikes may trigger a counter which can be correlated to a clearance measurement or memory, or main storage 74 may include suitable programming code for computing the clearance directly from the number and magnitude of the spikes of the signal.

Figure 8:
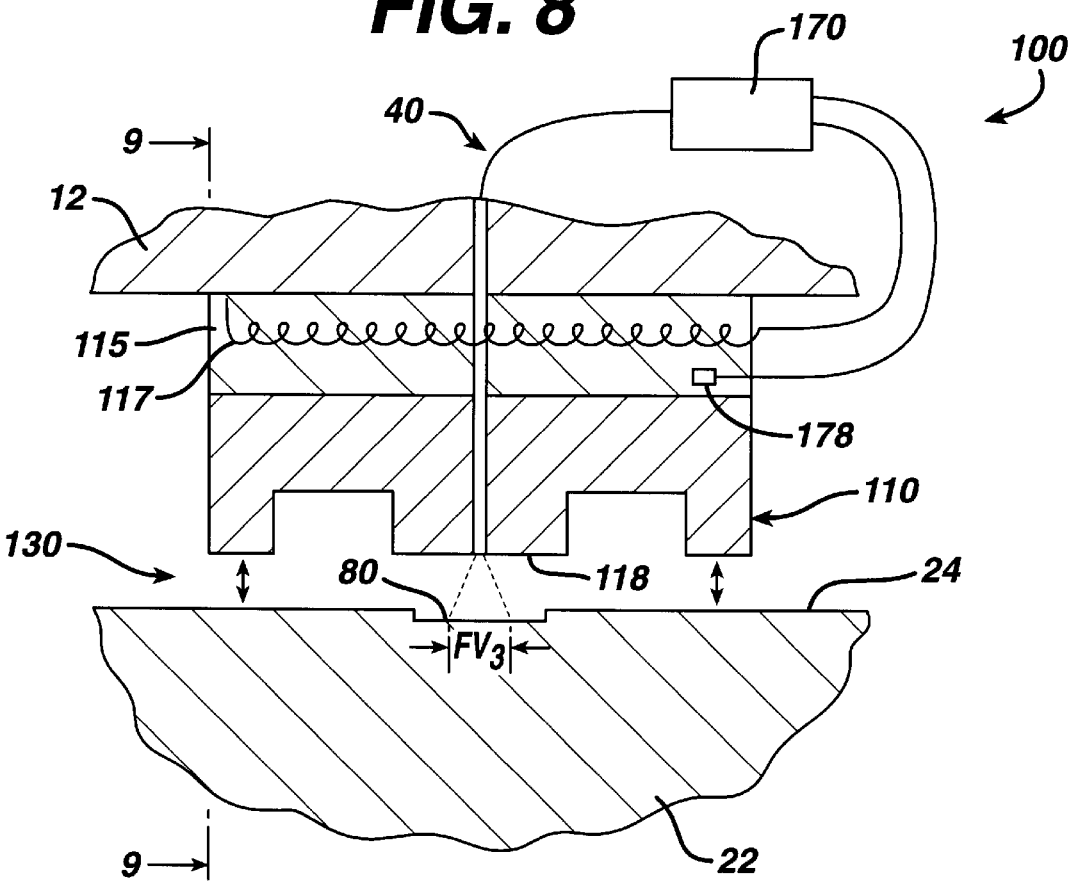
FIG. 8 is a cross-sectional view of a non-contact, clearance adjusting system according to the present invention operable for adjusting the magnitude of a clearance.
Figure 9:
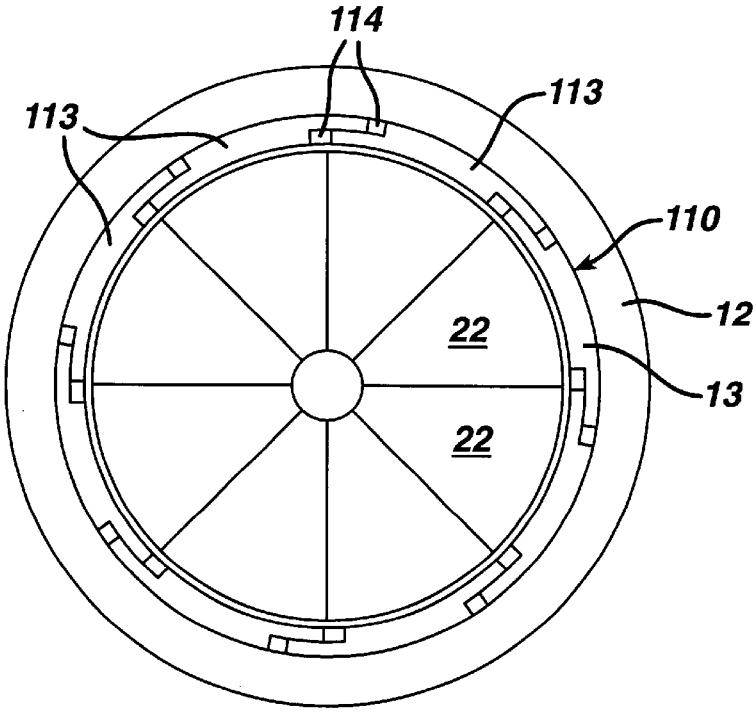
FIG. 9 is a sectional view taken along line 9—9 in FIG. 8.

In another aspect of the present invention, as shown in FIGS. 8 and 9, a non-contact, clearance adjusting system 100 is operable to selectively adjust a clearance 130 during operation between rotating rotor blade tip surface 24 and a surface 118 of a labyrinth seal 110 attached to a casing 12 in response to an observed field of view FV3.

For example, clearance 130 is desirably adjusted and optimized during start-up when rotor blades 22 heat up faster than casing 12 (to avoid rubs), during steady state operation (to reduce the gap to increase the efficiency), and during shut down when casing 12 cools down faster than blades 22 (to avoid rubs). Desirably, clearance adjusting system 100 allows a reduction in the cost of manufacture, an increase in efficiency, and an increase in the life of the rotating system.

In this exemplary embodiment, clearance adjusting system 100 includes a clearance measuring system 40, and labyrinth seal 110 comprising a plurality of labyrinth seal segments 113 having a thermally expandable portion 115 attachable to casing 12. Thermally expandable portion 115 is operably attached to a controller 170 which is operable to feed an electrical current to a resistive heating element 117 in thermally expandable portion 115 to heat thermally expandable portion 115 causing labyrinth seal surface 118 to move inwardly toward rotor blade tip surface 24 to reduce clearance 130. By stopping the electrical current to resistive heating element 117, labyrinth seal surface 118 moves away from rotor blade tip surface 24. As shown in FIG. 9, notches or overlaping portions 114 accommodate circumferential expansion and contraction between adjacent segments 113. A single system 100 may be employed or two or more seal. segments 113 may each include a system 100. A temperature sensor 178 may also be used in the monitoring and adjusting of the expansion of labyrinth seal 110 as well as clearance measuring system 40.

Figure 10:
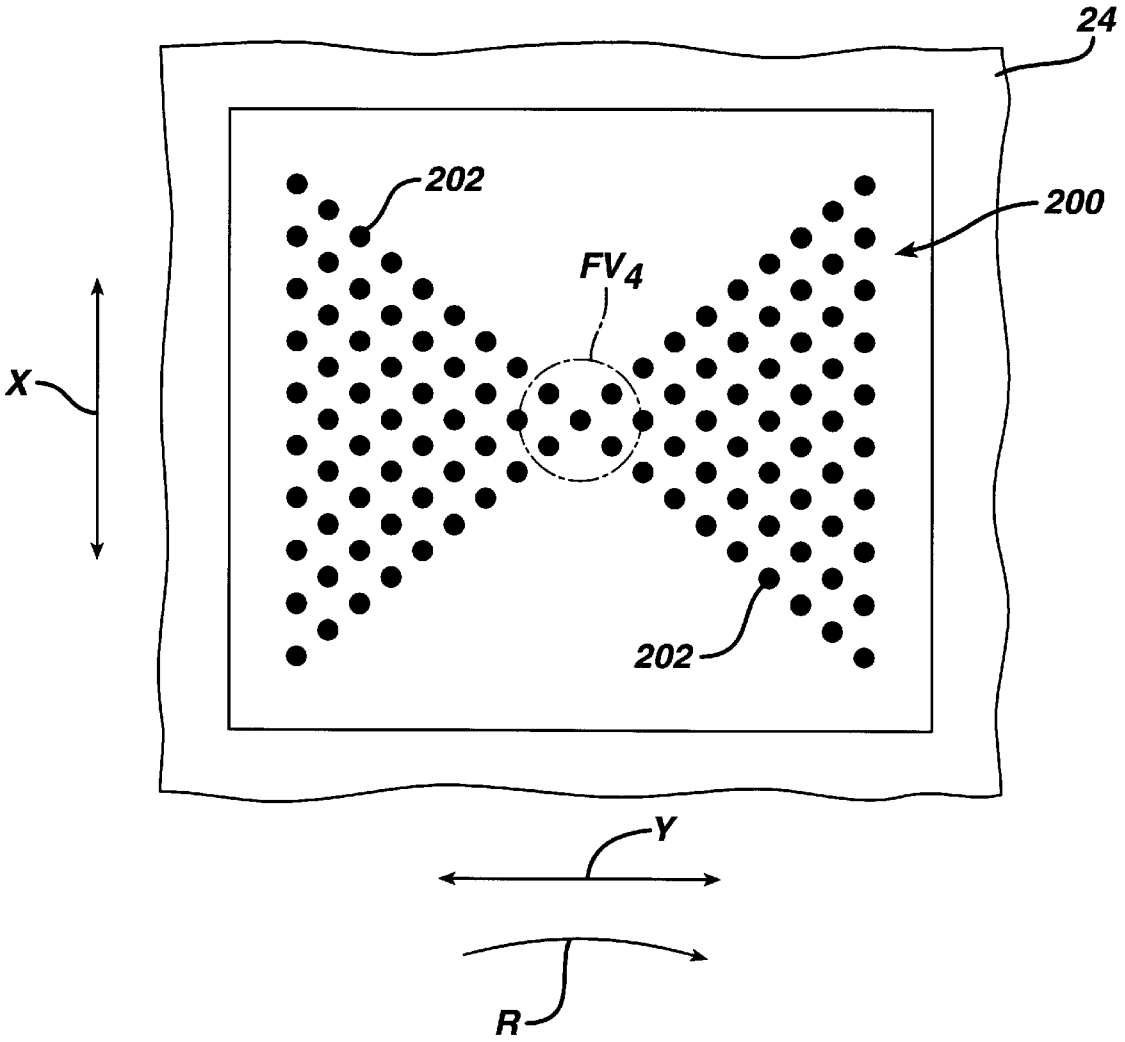
FIG. 10 is a top view of an alternative embodiment of a target, having a varying pattern for use in the detection of vibrations of the rotor blade, shown in FIG. 1, according to the present invention.

In still another aspect of the present invention, vibrations (e.g., axial oscillations along the length of a longitudinal axis of the shaft or torsional oscillations of the shaft) of the rotor blade may be detected. Desirably, for detecting vibrations, a target 200 attachable to a rotor blade tip 24 includes a two-dimensional pattern of reflective elements 202 as illustrated in FIG. 10.

Vibrations of rotor blade tip surface 24 cause target 200 to move relative to field of view FV3. By aligning and sensing target 200 at, e.g., top dead center, of each rotation of the rotor, and by monitoring the changing signal detected, and selectively strobing the target, vibrations of the blade can be detected. For example, in this embodiment, memory or main storage of a controller (e.g., controller 70 in FIGS. 2 and 3) is operable to store a predetermined database of the magnitude of signal measurements to a field of view. A controller is operable to compare the changing magnitude of the signal over time (the clearance and the field of view being generally constant) as target 200 moves relative to field of view FV4. During operation, axial vibrations, i.e., motion of the blade forward and aft, will cause reflective elements 202, or a portion thereof, of target 200 to move in the direction of double-headed arrow X and out of field of view FV4 which reduces the magnitude of the signal detected and analyzed. Over a period of time, the varying or changing signal can be related and determined by the controller to a frequency of vibration of the rotor blade. Similarly, torsional oscillation may be detected and determined by a varying or changing signal due to target 200 moving in the direction of double-headed arrow Y.

Advantageously, target 200 is not symmetrical so that the varying signal due to axial vibrations and torsional vibrations will cause different changes in the magnitude of the signals detected.

While only certain features of the invention have been illustrated and described, many modifications and changes will occur to those skilled in the art. It is therefore to be understood that the appended claims are intended to cover all such modifications and changes as fall within the scope of the invention.

What is claimed is:

1. A system for measuring a clearance between a surface of a first object and a surface of a second object, said system comprising:

a sensor attachable to the first object for sensing within a field of view a portion of the second object having a varying pattern and generating a signal in response thereto, said field of view varying in response to varying the clearance between said sensor and the second object; and a controller for determining a clearance between the surface of the first object and the surface of the second object in response to said signal wherein the second object is a rotatable object.

2. The system according to claim 1, wherein said controller is operable to determine the clearance in response to a magnitude of said signal.

3. The system according to claim 2, wherein the clearance varies substantially proportionally to said magnitude of said signal.

4. The system according to claim 1, wherein said controller is operable to determine the clearance in response to said signal comprising a plurality of signals.

5. The system according to claim 1, wherein the varying pattern comprises a linear pattern of spaced-apart reflective elements.

6. The system according to claim 1, wherein said signal comprises a plurality of signals generated in response to the portion of the second object passing through said field of view.

7. The system according to claim 1, further comprising an emitter for radiating the portion of the second object.

8. The system according to claim 7, wherein said controller is operable to synchronize radiation emitted from said emitter as the portion of the second object passes through said field view.

9. The system according to claim 1, wherein said sensor comprises a mask having a viewport.

10. The system according to claim 1, wherein said sensor comprises a photodiode.

11. A system for adjusting the clearance between a first object and a second object, said system comprising:

a movable seal disposed between the first object and the second object;

a sensor attachable to the first object for sensing within a field of view a portion of the second object and generating a signal in response thereto; and a controller operable to adjust a position of said seal relative to the second object having a varying pattern to selectively adjust the clearance therebetween in response to said signal.

12. The system according to claim 11, wherein said seal comprises a labyrinth seal.

13. The system according to claim 11, wherein said seal comprises a plurality of segments.

14. The system according to claim 11, wherein said seal comprises a thermally expandable portion.

15. The system according to claim 14, further comprising a temperature sensor for monitoring a temperature of said thermally expandable portion.

16. The system according to claim 14, wherein the second object is a rotatable object.

17. A method for measuring a clearance between a surface of a first object and a surface of second object, said method comprising the steps of:

sensing within a field of view a portion of the second object having a varying pattern and generating a signal in response thereto, said field of view varying in response to varying the clearance between the first object and the second object; and determining the clearance between the first object and the second object in response to said signal;

wherein the second object is a rotatable object.

18. The method according to claim 17, wherein said step of determining the clearance comprises the step of comparing a magnitude of said signal to a predetermined magnitude corresponding to the clearance.

19. A system for adjusting the clearance between a first object and a second object, said system comprising:

a movable seal disposed between the first object and the second object;

a sensor attachable to said seal for sensing within a field of view a portion of the second object and generating a signal in response thereto; and a controller operable to adjust a position of said seal relative to the second object having a varying pattern to selectively adjust the clearance therebetween in response to said signal.

* * * * *